US007799271B2

(12) United States Patent
Wojcieszynski

(10) Patent No.: US 7,799,271 B2
(45) Date of Patent: Sep. 21, 2010

(54) NI-BASE WEAR AND CORROSION RESISTANT ALLOY

(75) Inventor: Andrzej L. Wojcieszynski, Pittsburgh, PA (US)

(73) Assignee: Compaction & Research Acquisition LLC, Pittsburg, PA (US)

( * ) Notice: Subject to any disclaimer, the term of this patent is extended or adjusted under 35 U.S.C. 154(b) by 697 days.

(21) Appl. No.: 11/752,584

(22) Filed: May 23, 2007

(65) Prior Publication Data

US 2007/0292304 A1 Dec. 20, 2007

Related U.S. Application Data

(60) Provisional application No. 60/814,081, filed on Jun. 16, 2006.

(51) Int. Cl.
*C22C 19/05* (2006.01)

(52) U.S. Cl. ..... 420/448; 148/428

(58) Field of Classification Search ..... 420/448; 148/428

See application file for complete search history.

(56) References Cited

U.S. PATENT DOCUMENTS

| | | | | |
|---|---|---|---|---|
| 3,779,719 | A * | 12/1973 | Clark et al. | 428/652 |
| 4,576,642 | A | 3/1986 | Holtz, Jr. | |
| 4,727,740 | A | 3/1988 | Yabuki et al. | |
| 6,238,620 | B1 | 5/2001 | Liu et al. | |

FOREIGN PATENT DOCUMENTS

| | | |
|---|---|---|
| EP | 0773305 | 5/1997 |
| EP | 1647606 | 9/2005 |

* cited by examiner

*Primary Examiner*—Roy King
*Assistant Examiner*—Jessee R. Roe
(74) *Attorney, Agent, or Firm*—Finnegan, Henderson, Farabow, Garrett & Dunner LLP

(57) ABSTRACT

Nickel base alloys for use in applications for highly corrosive and abrasive environments. The alloys contain a large volume fraction of metallic carbide particles that provide wear and abrasion resistance. The alloys are produced by induction melting and gas atomization to form alloy powder particles. The particles are consolidated by hot isostatic pressing to form a solid article.

8 Claims, 3 Drawing Sheets

An example of the microstructure of the alloys of invention – the optical microstructure of alloy WR-9 etched in Beraha's etchant: nickel based matrix (dark phase) with alloy carbides (white particles): a) magnification 200x, b) magnification 500x. Note the volume fraction of carbides in this alloy to be larger than that in alloy WR 11.

An example of the microstructure of the alloys of invention – the optical microstructure of alloy WR-11 etched in Beraha's etchant: nickel based matrix (dark phase) with alloy carbides (white particles): a) magnification 200x, b) magnification 1000x.

An example of the microstructure of the alloys of invention – the optical microstructure of alloy WR-9 etched in Beraha's etchant: nickel based matrix (dark phase) with alloy carbides (white particles): a) magnification 200x, b) magnification 500x. Note the volume fraction of carbides in this alloy to be larger than that in alloy WR 11.

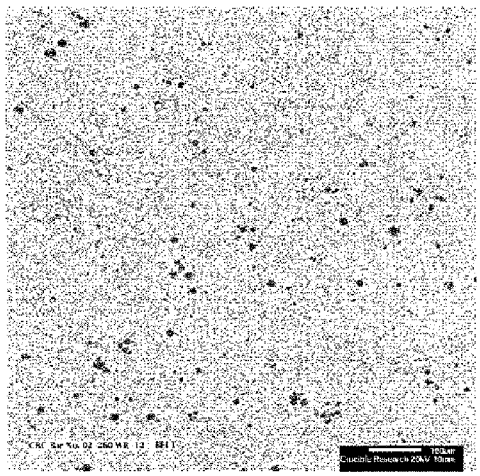

FIGURE 3a

An SEM microstructure of the alloy of invention, WR-12, showing a dual distribution of carbides: larger carbide particles sparsely distributed and smaller carbide particles distributed closely to each other within the alloy matrix.

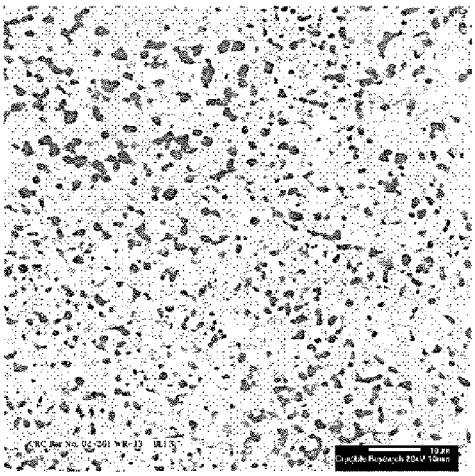

FIGURE 3b

Backscattered electron SEM microstructure of the alloy of invention, WR-13, revealing carbide particles of different composition (different contrast).

NI-BASE WEAR AND CORROSION RESISTANT ALLOY

This application claims benefit of U.S. Provisional Application No. 60/814,081, filed Jun. 16, 2006, the contents of which are incorporated herein by reference.

DESCRIPTION OF THE INVENTION

1. Field of the Invention

This invention relates to a family of nickel base alloys designed for applications in highly corrosive and abrasive environments. More specifically this invention relates to a family of corrosion resistant nickel base alloys which contain a large volume fraction of carbide particles resulting in improved resistance to abrasive wear. These alloys are produced by melting a prescribed composition in an induction furnace and gas atomizing to produce alloy powder particles. Then the produced alloy powder particles are consolidated by a hot isostatic pressing (HIP) process to obtain a solid alloy bar, or the alloy powder can be used for HIP/Clading to produce a wear/corrosion resistant layer on critical surfaces of components which are exposed to abrasive/corrosive environments. The produced powder can also be applied to critical surfaces to produce a wear/corrosion resistant layer using alternative methods, such as various spray deposition methods, plasma transfer, laser deposition, and the like.

2. Background of the Invention

Advances in manufacturing technologies and development of new manufacturing processes result in continuously increasing demands on materials used to build advanced machinery for these demanding applications. Many applications involve complex and aggressive service environments in which machine components and tooling are subjected to multiple factors, such as impact loading, severe corrosion, and extensive wear. Processing of dry food and processing of plastics, i.e., plastic injection molding or plastic extrusion, are some examples of the most demanding applications. Modern plastics frequently contain additions of ceramic fibers to improve their functional properties. These additions of fibers increase substantially the abrasiveness of the plastics, which presents an increased challenge to the materials that are used to build the elements of the plastic injection molding machines and extruders, i.e., barrels, screws, screw tips, return valves, etc. . . . One of the most challenging applications is processing of fluoropolymers, such as TEFZIL, TEFLON and the like. To aid in the formation of the proper polymer structure this processing requires elevated temperature and a moist environment. This environment results in formation of hydrofluoric (HF) acid which is very corrosive. Also, in processing of non-fluoropolymer plastics, some organic and/or non-organic corrosive acids may form, which results in a severe corrosive environment.

Similar challenges need to be solved in the dry food processing industry. All dry food is highly abrasive due to its consistency and dispersion. Dry food typically contains salt as a main preserving additive, which is highly corrosive to iron based alloys. Also, organic acids, such as acetic acid frequently present in dry food, are very corrosive to iron based alloys. The aggressive environments make ordinary wear resistant tool steels unsatisfactory for these applications, and even wear and corrosion resistant advanced tool steels do not provide satisfactory performance in these demanding conditions.

Materials commonly used to construct components of injection machines and extruders are wear resistant cold work tool steels such as CPM® 9V and CPM® 10V, wear and corrosion resistant tool steels such as CPM® S90V, and nickel based alloys. Regular cold work tool steels such as CPM® 9V or CPM® 10V, despite their good wear resistance, have insufficient corrosion resistance in many applications involving plastics or dry food processing. In some of these applications even wear resistant stainless tool steels, such as CPM® S90V, do not have sufficient corrosion resistance. Commercial nickel base superalloys have excellent corrosion resistance and from the corrosion standpoint they would perform satisfactorily in most of these applications. However, their main deficiency is inadequate or lack of wear resistance. Several alloys have been developed by mixing nickel based alloy powder, which form the matrix of the alloy, with hard particles such as tungsten carbides to improve the wear characteristics of the alloy, or by "impregnating" a nickel based substrate with hard particles. Such techniques, however, have their own limitations, most important of which are:

- large carbide particles are usually angular and have a detrimental effect on the toughness of the final product;
- hard particles have a tendency to segregate either during mixing or during fusing resulting in non-homogeneous distribution of the hard particles, which results in "soft spots" in the final microstructure and nonuniform wear characteristics of the protective layer.

The goal of this invention is to provide a wear resistant nickel based alloy in which wear resistance can be achieved by "in-situ" precipitation of hard phases, primarily metallic carbides, from a homogeneous molten metal to obtain a uniform and homogeneous distribution of hard particles within a homogeneous matrix.

SUMMARY OF THE INVENTION

In accordance with the invention, the alloys of the invention are nickel based alloys containing an addition of carbon and additions of strong carbide forming elements such as chromium, vanadium, tungsten, molybdenum, and titanium. All elements are balanced to allow for the formation of a large volume fraction of alloy carbides containing primarily vanadium, chromium, titanium and molybdenum. The primary role of these carbide particles is to improve wear characteristics and to increase the resistance to abrasion of the alloys of the invention. Additionally, the alloying elements remaining in the matrix contribute to the hardness of the alloy by solid solution strengthening and by precipitation of intermetallic phases. The alloys of the invention consist of the following elements:

Carbon—is present in the amount of 1.0-6.0%, preferably 2.0-5.5%, and its primary function is to form carbides with the carbide forming elements such as vanadium, chromium, and molybdenum. Other elements present in lesser quantity, such as titanium and zirconium, may partially dissolve in the vanadium rich carbides or form a small amount of a separate carbide. The excess carbon dissolved in the matrix is not desired because it segregates to the grain boundaries and deteriorates toughness. The amount of carbon is closely related to the amount of carbide forming elements (CFE) through the relationship:

$$1.1<CFE/C<2.5$$

Where:

$CFE=0.2*\%\ V+0.25*\%\ Ti+0.06*\%\ Mo+0.063*\%\ Cr$;

C—amount of carbon in the alloy in wt. %;

% V, % Ti, % Mo, % Cr—amount of vanadium, titanium, molybdenum and chromium, respectively, in the alloy of the invention in wt. %.

Chromium—is present in the amount of 14.0-25.0%, preferably 16.0-22.5%. A portion of the chromium forms carbides, which contribute to the improved wear resistance of the alloys. The remaining portion of the chromium is dissolved in the matrix contributing to solid solution strengthening. Chromium also forms a thin adherent layer of oxide on the alloy surface, which protects the alloy from corrosive environments.

Vanadium—is present in the amount of 8.0-22.0%, preferably 10.0-20.0%. The main purpose of the vanadium addition is to form hard, wear resistant vanadium rich MC carbides, where M indicates metallic atoms, primarily vanadium. Also other metallic atoms such as chromium, titanium, and molybdenum, which can substitute for the vanadium atoms, may partition to the MC carbides, or form a separate carbide. Vanadium must be present in the amount at least three times greater than the amount of carbon, i.e., % V/% C>3. Lesser amounts of vanadium result in an excess of carbon available for the formation of carbides with other elements, such as chromium, titanium and molybdenum, which is not desired. Too small an addition of vanadium results in an insufficient volume fraction of carbides and mediocre wear characteristics of the alloy. If the addition of vanadium and carbon are excessively large, this may result in an excessive volume fraction of carbides, which have a detrimental effect on the toughness characteristic of the alloy. An excessive volume fraction of carbides also increases manufacturing difficulties and deteriorates the machining and grinding characteristics of the alloy.

Molybdenum—is present in the amount of 6.0-15.0%, preferably 8.0-13.0%. It partitions to both the carbides and the matrix. It may form separate $M_6C$ or $M_{23}C_6$ carbides or in the alloys with large amounts of vanadium it may dissolve in the MC carbides. Molybdenum dissolved in the matrix contributes to solid solution strengthening.

Cobalt—is present in the amount of 5.0-14.0%, preferably 6.0-12.0%. It does not form carbides and remains in the matrix. Cobalt atoms can substitute for nickel atoms in the gamma prime (γ') precipitates.

Titanium—is present in the amount of 1.0-7.0%, preferably 2.5-5.0%. The main purpose of titanium is to form γ' precipitates and to provide for matrix strengthening. Titanium, however, is also a strong carbide forming element and a large portion of titanium is tied-up with carbon because of the available carbon. Because of this, the titanium content in the alloys of the invention is relatively high in comparison to the titanium content of commercial Ni-based superalloys.

Aluminum—is present in the amount of 1.0-4.0%, preferably 1.0-2.5%, and its primary function is to form γ' precipitates and strengthen the alloy matrix. It also forms an adherent oxide layer at elevated temperatures which helps to protect the alloy at these temperatures.

Zirconium—can be present in the amount of up to 2.0%, preferably up to 1.5%. It is a strong carbide former and combines with carbon. The remaining portion tends to segregate to the grain boundaries.

Silicon—can be present in the amount up to 1.0%, preferably not more than 0.5%. It is a strong deoxidizer and should be considered as a residual element resulting from the melting process.

Nickel—balance. It is the main element of the matrix providing for the key properties of the alloy, primarily the strength at the elevated temperature. It forms also the γ' precipitates which contribute to the strength of the alloy.

All percentages are in weight percent.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 1(*b*) shows the etched microstructure (magnification of 1000×) of an alloy of the invention and specifically alloy WR-11;

FIG. 2(*b*) shows the etched microstructure (magnification of 500×) of an alloy of the invention and specifically alloy WR-9;

FIG. 3(*a*) shows the SEM microstructure (magnification of 100×) of an alloy of the invention and specifically alloy WR-12;

FIG. 3(*b*) shows the backscattered electron SEM image of the microstructure (magnification of 1000×) of an alloy of invention and specifically alloy WR-13.

DESCRIPTION OF THE EMBODIMENTS

Figure 1A:
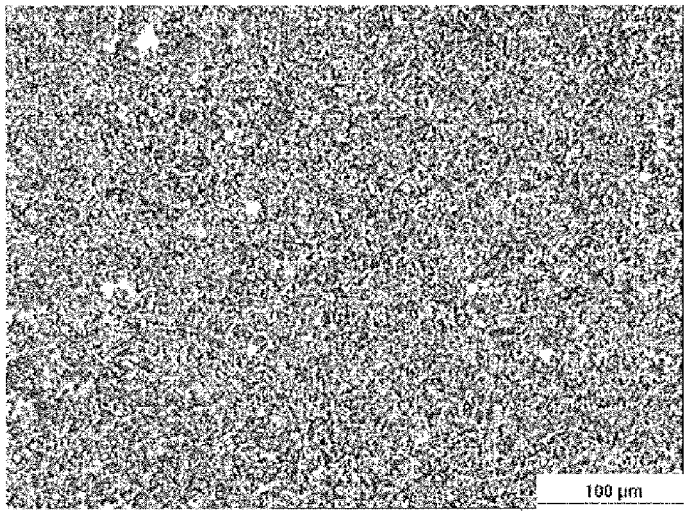
FIG. 1(*a*) shows the etched microstructure (magnification of 200×) of an alloy of the invention and specifically alloy WR-11.

Reference will now be made in detail to the present exemplary embodiments of the invention, examples of which are illustrated in the accompanying drawings.

Chemistry

TABLE 1

WEAR CORROSION RESISTANT Ni-BASED ALLOYS OF INVENTION

| Alloy ID | Bar ID | Ni | Cr | V | Mo | Co | Ti | Al | Zr | Si | Mn | C |
|---|---|---|---|---|---|---|---|---|---|---|---|---|
| WR-9 | 01-184 | bal. | 21.73 | 13.83 | 11.07 | 7.31 | 4.97 | 1.88 | 0.75 | 0.06 | | 4.49 |
| WR-10 | 02-173 | bal. | 20.19 | 19.38 | 9.40 | 6.89 | 4.42 | 2.06 | 1.35 | 0.12 | | 5.25 |
| WR-11 | 02-259 | bal. | 18.15 | 10.20 | 8.75 | 10.10 | 3.04 | 1.46 | — | — | | 2.00 |
| WR-12 | 02-260 | bal. | 18.18 | 11.93 | 8.74 | 10.00 | 2.98 | 1.54 | — | — | | 2.45 |
| WR-13 | 02-261 | bal. | 16.77 | 15.15 | 8.64 | 9.23 | 3.04 | 1.55 | — | — | | 3.00 |
| WR-14 | 02-262 | bal. | 22.06 | 15.82 | 12.03 | 7.91 | 3.49 | 1.68 | — | — | | 3.74 |
| WR-15 | 04-033 | bal. | 19.87 | 12.09 | 11.93 | 10.95 | 3.39 | 1.45 | 0.12 | 0.06 | | 2.38 |
| WR-16 | 04-034 | bal. | 19.96 | 12.70 | 11.91 | 9.88 | 3.85 | 1.36 | 0.01 | 0.008 | | 2.75 |

TABLE 1-continued

| WEAR CORROSION RESISTANT Ni-BASED ALLOYS OF INVENTION | | | | | | | | | | | | |
|---|---|---|---|---|---|---|---|---|---|---|---|---|
| Alloy ID | Bar ID | Ni | Cr | V | Mo | Co | Ti | Al | Zr | Si | Mn | C |
| Reference Alloys of Prior Art | | | | | | | | | | | | |
| 440C | | bal.Fe | 17.50 | — | 0.50 | — | — | — | — | 0.30 | 0.50 | 1.00 |
| CPM ® S90V | | bal.Fe | 14.00 | 9.00 | 1.00 | — | — | — | — | 0.40 | 0.50 | 2.30 |
| Alloy 625 | | bal. | 22 | 4.0 Nb | 9 | 3.0 Fe | 0.2 | 0.2 | — | 0.3 | 0.15 | 0.05 |

Experimental Alloys

TABLE 2

| WEAR AND CORROSION RESISTANCE OF ALLOYS OF THE INVENTION AND REFERENCE ALLOYS | | | | | |
|---|---|---|---|---|---|
| Alloy ID | Bar ID | Hardness [HRC] | WR [mg] | Pitting Pot. vs. SCE 5% NaCl Epit, [mV] | Corrosion Rate 5% HF [mm/yr] |
| Alloys of the Invention | | | | | |
| WR-9 | 01-184 | 61.4 | 109 | | 0.41 |
| WR-10 | 02-173 | 63.4 | 71 | | |
| WR-11 | 02-259 | 50.1 | 424 | | |
| WR-12 | 02-260 | 51.7 | 240 | | |
| WR-13 | 02-261 | 52.9 | 155 | 503 | 0.7 |
| WR-14 | 02-262 | 62.7 | 60 | 357 | 0.34 |
| WR-15 | 04-033 | 55.2 | 301 | | 0.4 |
| WR-16 | 04-034 | 55.0 | 284 | 389 | 0.43 |
| Reference Alloys | | | | | |
| 440C | | 57.0 | 646 | −220 | |
| CPM ® S90V | | 59.0 | 84 | 5 | 27 |
| Alloy 625 | | 34 | 3275 | — | 0.07 |

The compositions of the experimental alloys were defined by carefully balancing the amount of alloying content and carbon. The alloys were design to provide a sufficient amount of carbon to form primary carbides. The compositions of the experimental alloys are listed in Table I. All alloys were melted in an electric induction furnace and gas atomized to produce a prealloyed powder. The produced powder was collected, screened to −16 mesh fraction, loaded into cylindrical containers and consolidated using hot isostatic pressing (HIP). All alloys were successfully consolidated into solid bars from which sample coupons were sectioned for corrosion and wear resistance testing. Corrosion and wear testing were performed on alloys of the invention in the as-HIP condition. One of the advantages of the alloys of the invention is that they can be used in the as-HIP condition and do not require heat treatment. This may shorten and simplify the entire manufacturing process. Several alloys were tested as reference alloys for comparative purposes. These include two martensitic wear and corrosion resistant tool steels, conventional 440C and powder metallurgy CPM S90V. These alloys were selected for comparison because they are typical tool materials often used in applications for which the alloys of the invention are intended to be used. Additionally, a nickel based superalloy, Alloy 625, was included for comparative testing because it is used sometimes in applications involving a HF environment. However, its performance is often unsatisfactory because it lacks adequate wear resistance.

The alloys of the invention combine the performance characteristics of iron based tool steels and nickel based superalloys, i.e., the alloys of the invention have a wear resistance similar to martensitic wear resistant tool steels and maintain corrosion resistance similar to that of nickel based alloys.

Corrosion resistance: Potentiodynamic tests were used to evaluate the corrosion resistance of several alloys of the invention and the reference alloys for comparison. The pitting resistance of the alloys was measured in a 5% NaCl solution. The tests were conducted according to ASTM G5. The pitting resistance of the alloys is defined by the pitting potential ($E_{pit}$) obtained from a potentiodynamic curve. The more positive the pitting potential, the more resistant the alloy is to pitting. The alloys of the invention were tested in the as-HIP condition, the reference alloys were tested in a typical heat treat condition commonly used for typical applications. The test results of the corrosion tests are given in Table II.

The pitting potentials for the iron based alloys, 440C and CPM S90V, were −220 mV and 5 mV, respectively. The pitting potentials for several of the alloys of the invention, i.e., WR-13, WR-14 and WR-16, were 503 mV, 357 mV and 389 mV, respectively, which indicates much better resistance to pitting of the alloys of the invention than the wear/corrosion resistant tool steels.

The second corrosion test was conducted in 5% hydrofluoric acid (HF). The tests were conducted according to ASTM G59. The corrosion rates, Table II, were calculated from the data collected during the test according to ASTM F102. In this test, the lower the corrosion rate, the more resistant the alloy is to general corrosion. Alloy 625 and CPM S90V were tested for reference. The best corrosion resistance in the HF solution was measured for Alloy 625; its corrosion rate was 0.07 mm/yr. The corrosion rate in the HF solution of the alloys of the invention was 0.34-0.7 mm/yr. This corrosion rate is somewhat higher than the corrosion rate of the Ni-based superalloy but it is much lower than the corrosion rate of CPM S90V, which was measured to be 27 mm/yr. CPM S90V is considered as one of the best commercially available wear/corrosion resistant martensitic tool steels.

Wear Test: Wear resistance was tested using a dry sand rubber wheel abrasive test which is often used to test materials for applications such as plastic injection molding, plastic extrusion or food processing. Testing was performed according to ASTM Standard G65, Dry Sand Rubber Wheel Abrasive Test. Again, the alloys of the invention were tested in the as-HIP condition, and the reference alloys were heat treated to their typical application hardness. The test results are given in Table II. The abrasion weight loss in the ASTM G65 test for CPM S90V tool steel was 84 mg and for 440C tool steel was 646 mg. The abrasion weight loss for the alloys of the invention varied from 60 mg to 424 mg, depending on the alloy composition and the volume fraction of carbides. The alloys with the larger amount of carbon and carbide forming elements (alloys WR-9, WR-10, WR-14) had a lower weight loss and were comparable to the weight loss of CPM S90V. The alloys of the invention containing lower amounts of carbon and carbide forming elements had a weight loss somewhat higher, from 155 mg to 424 mg, but still lower than another wear/corrosion resistant tool steel 440C, for which the abrasion weight loss was 646 mg. The weight loss for superalloy Alloy 625 was 3275 mg, at least an order of magnitude larger than those for the alloys of the invention.

Figure 1B:
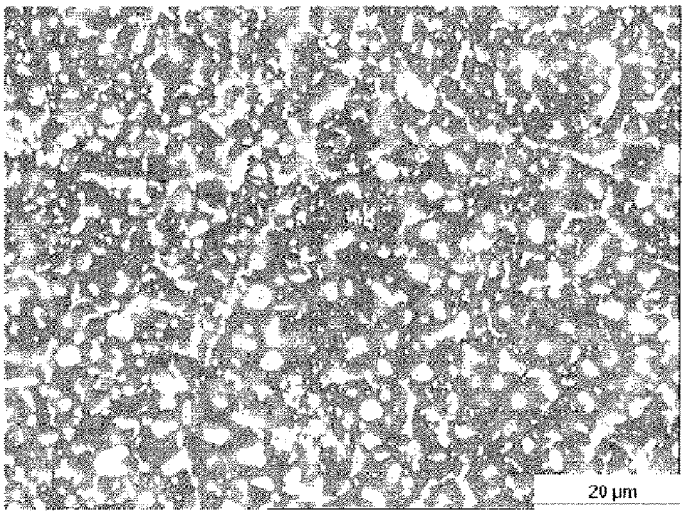
Figure 2A:
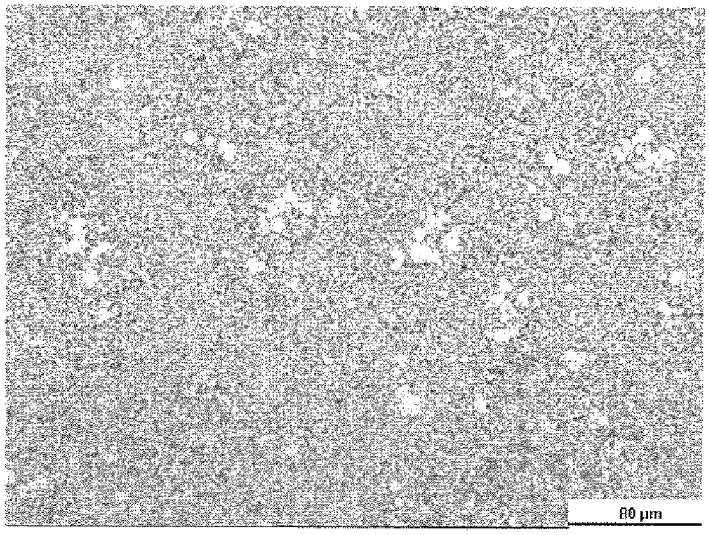
FIG. 2(*a*) shows the etched microstructure (magnification of 200×) of an alloy of the invention and specifically alloy WR-9.
Figure 2B:
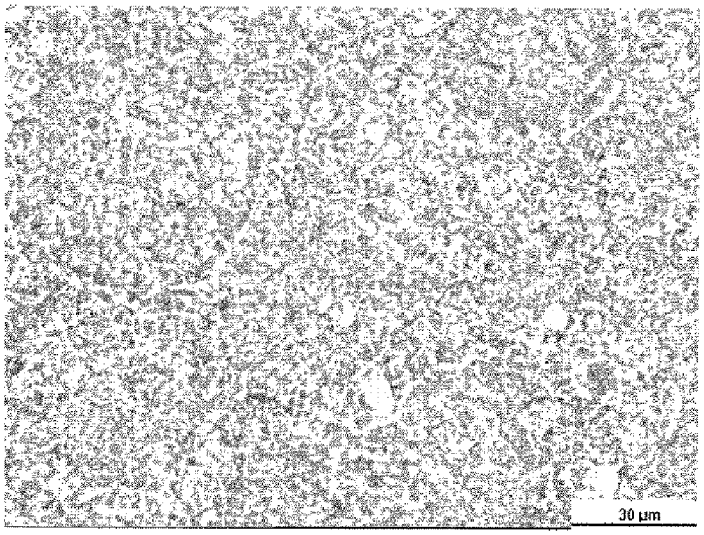

Microstructure: The microstructure of alloys of the invention was examined with optical and scanning electron microscopes (SEM). Metallographic specimens for optical microscope examination were polished and etched with Beraha's etchant. Examples of the optical microstructure are shown in FIG. 1 and FIG. 2. The microstructure consists of alloy carbide particles uniformly distributed in the Ni-based matrix. The volume fraction of primary carbide particles depends on the carbon content and the amount of carbide forming elements, and in the compositions with the largest amount of carbon and carbide formers the volume fraction of carbides can be up to 55%. SEM examination of the microstructure was performed on metallographic specimens in the as-polished condition. An example of an SEM microstructure is shown in FIG. 3. EDS analysis of the carbide particles revealed the presence of three types of carbides:

titanium-vanadium-molybdenum-chromium rich;

vanadium-molybdenum-titanium-chromium rich, and;

chromium-molybdenum-vanadium rich.

The elements are listed in order of decreasing content within a given type of carbide.

Manufacturing Experience: The alloys of the invention, WR-13 and WR-16, were used to produce twin HIP/Clad barrels for plastic injection molding machines. Both alloys were successfully applied to the inside diameter (ID) of the barrel openings by hot isostatic pressing, which resulted in full consolidation of the powder and good metallurgical bonding of the HIP/Clad layer to the barrel substrate. Both barrels were successfully finished machined to original specifications and were submitted to a customer for field trials.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A nickel based wear and corrosion resistant alloy consisting essentially of in weight percent:

carbon—2%-5.5%; chromium—16%-22.5%; vanadium—10%-20%; molybdenum—8%-13%; cobalt—6%-12%; titanium—2.5%-5%; aluminum—1%-2.5%; zirconium—up to 1.5%; silicon—up to 0.5%; and balance essentially nickel and incidental impurities.

2. A nickel based wear and corrosion resistant alloy consisting essentially of in weight percent:

carbon—4%-5%; chromium—20%-23%; vanadium—12%-15%; molybdenum—10%-12.5%; cobalt—6.5%-8.0%; titanium—4%-6%; aluminum—1.5%-2.5%; zirconium—up to 1.2%; silicon—up to 0.5%; and balance essentially nickel and incidental impurities.

3. A nickel based wear and corrosion resistant alloy consisting essentially of in weight percent:

carbon—5%-6%; chromium—19%-21%; vanadium—18%-20%; molybdenum—8.5%-10.5%; cobalt—6%-8%; titanium—4%-5%; aluminum—1.5%-2.5%; zirconium—up to 2%; silicon—up to 0.5%; and balance essentially nickel and incidental impurities.

4. A nickel based wear and corrosion resistant alloy consisting essentially of in weight percent:

carbon—2%-3%; chromium—17%-19%; vanadium—11%-13%; molybdenum—8%-10%; cobalt—9%-11%; titanium—2.5%-4%; aluminum—1%-2%; zirconium—up to 0.5%; silicon—up to 0.5%; and balance essentially nickel and incidental impurities.

5. A nickel based wear and corrosion resistant alloy consisting essentially of in weight percent:

carbon—2.5%-3.5%; chromium—15.5%-18%; vanadium—14%-16%; molybdenum—8%-10%; cobalt—8%-10%; titanium—2.5%-4%; aluminum—1%-2%; zirconium—up to 0.5%; silicon—up to 0.5%; and balance essentially nickel and incidental impurities.

6. A nickel based wear and corrosion resistant alloy consisting essentially of in weight percent:

carbon—3.25%-4.25%; chromium—21%-23%; vanadium—14%-16%; molybdenum—11%-13%; cobalt—7%-9%; titanium—3%-4%; aluminum—1%-2%; zirconium—up to 0.5%; silicon—up to 0.5%; and balance essentially nickel and incidental impurities.

7. A nickel based wear and corrosion resistant alloy consisting essentially of in weight percent:

carbon—2%-3%; chromium—19%-21%; vanadium—11%-13%; molybdenum—11%-12%; cobalt—10%-12%; titanium—2.5%-4%; aluminum—1%-2%; zirconium—up to 0.5%; silicon—up to 0.5%; and balance essentially nickel and incidental impurities.

8. A nickel based wear and corrosion resistant alloy consisting essentially of in weight percent:

carbon—2.25%-3.25%; chromium—19%-21%; vanadium—12%-14%; molybdenum—11%-13%; cobalt—9%-11%; titanium—3%-4.5%; aluminum—1%-2%; zirconium—up to 0.5%; silicon—up to 0.5%; and balance essentially nickel and incidental impurities.

* * * * *